US009530392B2

(12) United States Patent
Anderson

(10) Patent No.: US 9,530,392 B2
(45) Date of Patent: Dec. 27, 2016

(54) METHOD FOR INCREASING THE SHAPE AND EFFECTIVE THICKNESS OF THE NECK OF A STRINGED MUSICAL INSTRUMENT

(71) Applicant: Mark L. Anderson, Glenwood, NJ (US)

(72) Inventor: Mark L. Anderson, Glenwood, NJ (US)

(73) Assignee: MLA Industries LLC, Glenwood, NJ (US)

( * ) Notice: Subject to any disclaimer, the term of this patent is extended or adjusted under 35 U.S.C. 154(b) by 15 days.

(21) Appl. No.: 14/553,145

(22) Filed: Nov. 25, 2014

(65) Prior Publication Data

US 2016/0148603 A1 May 26, 2016

(51) Int. Cl.

| | |
|---|---|
| ***G10G 5/00*** | (2006.01) |
| ***A41D 19/00*** | (2006.01) |
| ***G10D 1/08*** | (2006.01) |

(52) U.S. Cl.

CPC ..... *G10G 5/005* (2013.01); *A41D 19/00* (2013.01); *G10D 1/08* (2013.01)

(58) Field of Classification Search

CPC ..... G10G 7/00; G10G 5/00; G10G 5/005
USPC ..... 84/328, 453
See application file for complete search history.

(56) References Cited

U.S. PATENT DOCUMENTS

| | | | |
|---|---|---|---|
| 4,071,913 | A | 2/1978 | Rector |
| 4,561,122 | A | 12/1985 | Stanley |
| 5,511,445 | A | 4/1996 | Hildebrandt |
| 5,771,901 | A | 6/1998 | O'Brien |
| 5,867,868 | A | 2/1999 | Ward |
| 6,034,308 | A | 3/2000 | Little |
| 6,378,925 | B1 | 4/2002 | Greenlee |
| D630,676 | S | 1/2011 | Toone |
| D635,182 | S | 3/2011 | Toone |
| 7,895,669 | B2 | 3/2011 | Kleinert |
| 8,209,771 | B1 | 7/2012 | Sykes |
| 8,464,399 | B2 | 6/2013 | Herigstad |
| 2013/0186254 | A1 | 7/2013 | Strandberg |

FOREIGN PATENT DOCUMENTS

DE 102008015943 A1 * 10/2008 ..... G09B 15/06

* cited by examiner

*Primary Examiner* — Kimberly Lockett

(74) *Attorney, Agent, or Firm* — Graham S. Jones, II

(57) ABSTRACT

A method of adjusting the effective thickness and/or shape of the neck of a string instrument involves use of spacer device consisting of a precisely molded or shaped material such as wood, metal, or plastic that covers the palm of the hand between the thumb and index finger including the web, thenar compartment, central compartment and hypothenar compartment as well as distal and proximal palmer area used to precisely thicken and modify the shape of the neck of a stringed musical instrument. The spacer device may be bonded to a holder such as the palm area of a fingerless glove or to a strap device covering the palm of the hand using hook and loop bonding material or an adhesive. Alternatively the device may be directly attached to the neck of the instrument or attached to the palm of the hand or held in place by the pressure of the palm on the neck of the instrument. The wooden spacer has a low enough coefficient of friction to slide freely along the neck of a string instrument.

20 Claims, 13 Drawing Sheets

C SHAPE

D SHAPE

U SHAPE

HARD V SHAPE

MEDIUM V SHAPE

SOFT V SHAPE

35

METHOD FOR INCREASING THE SHAPE AND EFFECTIVE THICKNESS OF THE NECK OF A STRINGED MUSICAL INSTRUMENT

BACKGROUND OF THE INVENTION

The ability of a player of a string instrument to perform with an instrument having a neck such as a guitar can be negatively affected by a mismatch between the grasp and size of the hand of the player and the thickness and/or shape of the neck. The mismatched neck thickness problem exists where there is a gap between the neck of the instrument and the thenar and palmer areas of the hand. Where there is such a mismatch the neck grip is likely to be uncomfortable and over time cause finger and hand pain especially to a novice or older player. It can also cause the position of the instrument to become unstable and shift during playing. Such pain in the hand and instrument shifting makes it very difficult for the player to make accurate chord and note finger placements consistently.

To increase neck grip comfort and stability a player may make the mistake of increasing the stress on the forearm, wrist and fingers by turning the wrist from a straight position, in line with the forearm, to an upward bent position and the player may press harder with the fingers thereby eliminating the gap between the instrument and the hand. The player may also tighten the grip on the neck by positioning the thumb around the top of the neck and pushing down vertically in an attempt to make the grip more comfortable and to stabilize the position of the neck. Unfortunately, such repetitive stress actions cause pain to develop in the hand, fingers and joints. This can even cause nerve damage resulting in loss of sensation in the fingers.

A player may also make mistakes of making inappropriate body adjustments such as bending the wrist and/or tightening the grip to be more comfortable by moving the thumb to a vertical or a horizontal position and pushing excessively with the thumb on the back of the neck of the instrument. Both of these techniques are unsatisfactory because tightening the grip, bending the wrist or pushing with the fingers or thumb puts strain on the tendons of the wrist and may eventually cause tendinitis or repetitive strain injury in the muscles and joints of the hands, forearms, and wrists. All of these things contribute to stress on the hand of a player holding the neck of an instrument causing the player to tire quickly, resulting in decreased playing and/or practice time.

The pushing force of the vertical or a horizontal thumb positions also have the disadvantage of causing stress and discomfort of the shoulder and the back of the neck of the player. In such a case, I have found that it would be desirable to increase the effective thickness and shape of the instrument neck. That would eliminate any space between the palm of the hand and the neck of the instrument and still allow the wrist to remain straight, thereby allowing the player to relax the shoulder and neck stress while allowing the palm of the hand to move freely up and down the neck of the string musical instrument. Also, it would allow a firm, comfortable grip with the neck of the instrument entirely supported by the palm of the hand and it allow the fingers to move freely. This would allow the player to control the instrument and to play chords and notes more consistently, while helping the wrist to remain straight. Using the palm of the hand to help support the string musical instrument while still allowing it to move freely to the proximal and distal ends of the neck would also help to eliminate the need to bend the wrist and push with the fingers and thumb to grip the string musical instrument. This would also help to relax the shoulder and neck tension of the player. Moreover, that would help to put less strain on the tendons of the fingers and wrist protecting them and not tiring the hand of the player as quickly.

At quite a substantial cost stringed instrument necks can be made available in a variety of thicknesses, shapes and widths to accommodate the grip comfort and hand size of the player. This can be the most important factor in just how comfortable the neck feels to the player. Electric guitar neck thicknesses range from approximately 0.770 inches to over 1.000 inches in increments of 0.001 inch. Also the neck shape or "carve" or the shape and size of the back of the guitar neck can affect comfort and must be taken into consideration. Some necks are more rounded with a "U" or "C" shape and some have more of a "V" shape commonly known as a "Hard V" or "Soft V". These various neck shapes and thicknesses were common and readily available in the 1950's to 1960's. Currently they are available only on "vintage" guitars costing thousands of dollars or by custom order.

Today stock guitar necks are generally thinner. For example, the neck shape most commonly used by most manufacturers is the modern slim "C" shape or flat oval with a neck thickness of approximately 0.8 inches and a 7.5 inch radius. For overall comfort and playability of a stringed instrument, the radius of the neck must also be considered. Taking into consideration all of the variables including neck thickness, neck shape and neck radius the task of choosing an instrument with maximum comfort can be a monumental task, as well as very costly. The thickness and radius of a neck cannot be changed without replacing the entire neck with one having different specifications.

PRIOR ART

U.S. Pat. No. 5,867,868 of Ward describes wrapping a band of material around the handles of elongated objects such as baseball bats, golf clubs, hammers, hoes, axes, and the like to prevent slipping from the hands of the user during use as well as preventing the formation of blisters or calluses on the hands of the user. It does not address the problem of instability of the grip which is important in the case of musical string instruments. Also, the neck of a stringed instrument cannot be wrapped and still be playable because it would cause various problems, such as covering the frets so the player cannot see the proper finger placement for the notes and keys Also it would distort the sound by providing an unsuitable support when the strings are pushed against it. In addition it would cause interference with the strings by decreasing and distorting the precise space between the neck and the strings of the instrument.

U.S. Pat. No. 5,771,901 of O'Brien is directed to protecting the body of the user when gripping an object such as a handle bar of a bicycle, but does not address the problem described above of avoiding instability of the grip on an object such as a neck of a string instrument. O'Brian is not directed to adjusting the thickness of an object grasped by the user.

U.S. Pat. No. 5,511,445 of Hildebrandt describes a disposable, and reusable, hand grip that is constructed as a flexible multi-ply band adapted to be wound around the circumference of a handle on a tool or other device, so that the person can exert an effective grip action on the hand grip which has the same problems as U.S. Pat. No. 5,867,868 of Ward. The concept of wrapping a band of material around the handle of a sports instrument such as a baseball bat is taught by Ward, but the teaching does not suggest that the band is composed of rigid material or that it is provided to improve the grip on the instrument. The purpose of Ward is not to adjust the thickness of the instrument to match the hand of the user, but to improve the grip of the athlete using the bat.

In accordance with an aspect of the method of this invention, the effective thickness and profile shape of the neck of string instrument is adjusted with a spacer such as a shim held in place or secured to the hand of the user. This method makes it possible for a player to achieve an enhanced grip on the neck of the string instrument using the palm of the hand rather than using increased thumb and finger pressure and bending the wrist. Use of a precisely made shim allows the player to quickly and economically determine the neck thickness, shape and radius that are most comfortable for optimization of his or her playing ability. The player can then choose an instrument closest to those specifications, have a neck custom made using those specifications or continue to use the particular size shim chosen for that particular instrument.

Furthermore, the method of this invention includes the step of inserting the spacer device with a uniform thickness in the thenar compartment of the hand, between the thumb and index finger, extending through the webbing of the thenar space The method includes the followings steps. The steps include providing a spacer which extends at least partially across radial longitudinal palm crease and/or further extending across central compartment and/or extending across the hypothenar compartment of the hand.

In accordance with another aspect of the method of this invention, a spacer is provided comprising a precisely molded or shaped device such as a shim which may be a rigid strip/splint of material such as wood, plastic or other stiff material with a low coefficient of friction that is designed to cover a portion of the palm of the hand between the thumb and index finger and between the web and little finger including the thenar compartment the central compartment and the hypothenar compartment as well as the distal palmer area and the proximal palmer area. The spacer precisely thickens and modifies the effective profile shape of the neck of an instrument such as a stringed musical instrument to precisely and comfortably fit the hand of the user/player. The spacer can be held against the neck of the instrument, attached to the exterior of a holder or inserted onto a holder. For example the spacer may be secured to the palm area of a fingerless glove or attached to a thin strap device covering the palm of the hand with a fastening means such as a hook/loop type fastener (Velcro®) or an adhesive.

Alternatively a precisely made shim could fabricated to be as long as the neck of the instrument and the device may be attached directly to the instrument neck.

Basic shapes for a strip or splint that thickens and modifies the effective shape of the neck are the C shape; a V shape or a U shape.

The thickness of the shim may be uniform across its length or tapered to be thicker at one end. For example it may be 2 mm in thickness at the thenar compartment and tapered to be thicker at the hypothenar compartment to further assist in keeping the wrist straight and keep it from bending while playing.

BRIEF DESCRIPTION OF THE DRAWINGS

FIGS. 3C and 3D are photographs showing a hand of a performer grasping the neck of a guitar (not shown) without a shim with some of the fingers of the hand positioned to make a chord. Notice how the palm of the hand is pressed against the neck so all the strings can be pressed down and that the wrist is strained because it is bent to the left. That illustrates the problem of performing a chord without a spacer between the palm and the neck of a string instrument.

FIG. 3E is a photograph showing a hand with a thumb and fingers extending from a glove secured to a wooden spacer. The spacer is in direct contact with the back of the neck of a string instrument with the fingers and the thumb grasping the front of the neck. Using the spacer provides support so all the strings can be pressed down while putting less of a bend in the wrist and removing some of the strain therefrom.

FIG. 5A also shows that the front side of the fastening patch comprises plain fabric strip secured to the hook fabric piece of patch FIG. 5B by stitching.

PREFERRED EMBODIMENTS OF THE INVENTION

Splint Embodiment

Figure 1A:
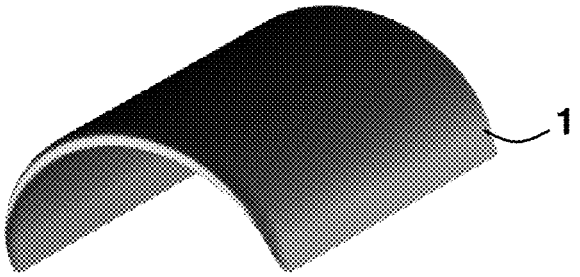
FIG. 1A-1F show some basic shapes of the various shapes of splints for use with the neck of a guitar. The splints are spacers, e.g. splints or strips that, in accordance with the present invention, effectively thicken the neck of guitar.
Figure 1B:
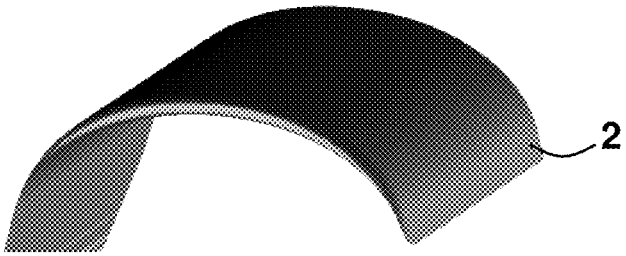

FIG. 1A-1F show some basic shapes of various shapes of splints that can complement the neck of a guitar in accordance with this invention. The splints comprise spacers, e.g. splints or strips that in accordance with the present invention effectively thicken the neck of guitar. Some shapes of splints for more typical necks of guitars are the C shape splint 1 of FIG. A; the V shaped splints 4, 5, or 6 as in FIGS. 1D-or the U shaped splint 3 as in FIG. 1C. FIG. 1B shows a D shaped splint 2. It is an important feature of the invention that the spacers 1-6 have a low enough coefficient of friction to slide freely along the neck of a string instrument.

FIGS. 1A-1 F are described in more detail below. The strip or splint can be attached to either the neck of the musical instrument, held in place using the palm of the hand or attached to the palm of the hand of the player with an adhesive material or a hook/loop type fastener such as Velcro®.

Figure 1C:
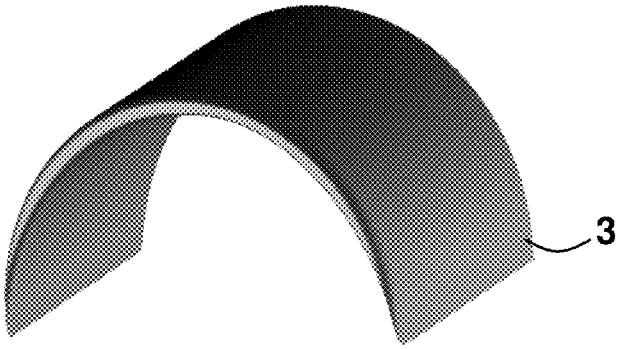
Figure 1D:
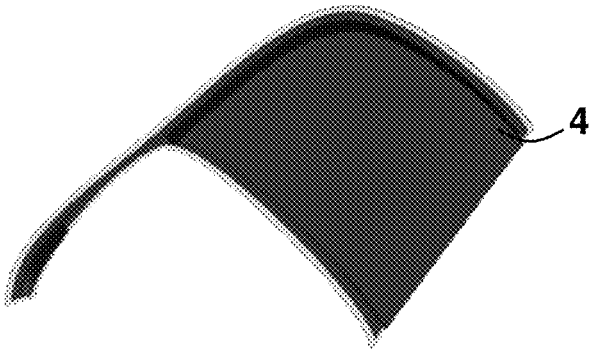
Figure 1E:
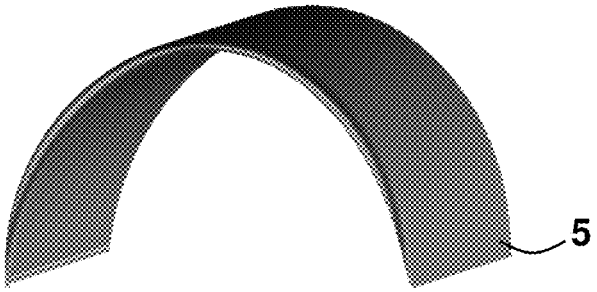
Figure 1F:
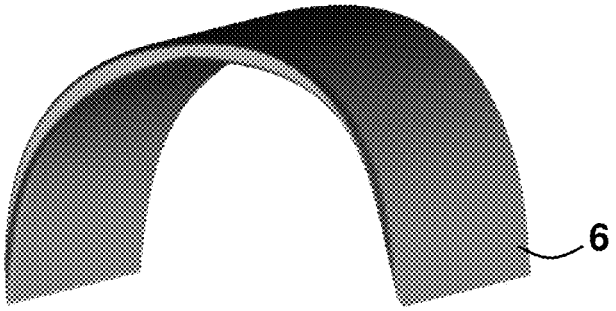

Examples of some possible strip or splint shapes, which are all 2 mm thick, and which are to be employed between the palm of the user and the neck of the string instrument are shown in FIGS. 1A-1F. FIG. 1A shows a C shaped splint 1, which is 38 mm wide, 19.8 mm tall, and 90 mm long. FIG. 1B shows a D shaped splint 2, which is 38 mm wide, 20.6 mm tall, and 90 mm long. FIG. 1C shows a U shaped splint 3, which is 38 mm wide, 21.9 mm tall, and 90 mm long. FIG. 1D shows a Hard V shaped splint 4, which is 38 mm wide, 22.1 mm tall, and 90 mm long. FIG. 1E shows a Medium V shaped splint 5 which is 38 mm wide 21.6 mm tall and 90 mm long. FIG. 1F shows a Soft V shaped splint 6 which is 38 mm wide 20.8 mm tall and 90 mm long.

Glove and Spacer Embodiment

Figure 2A:
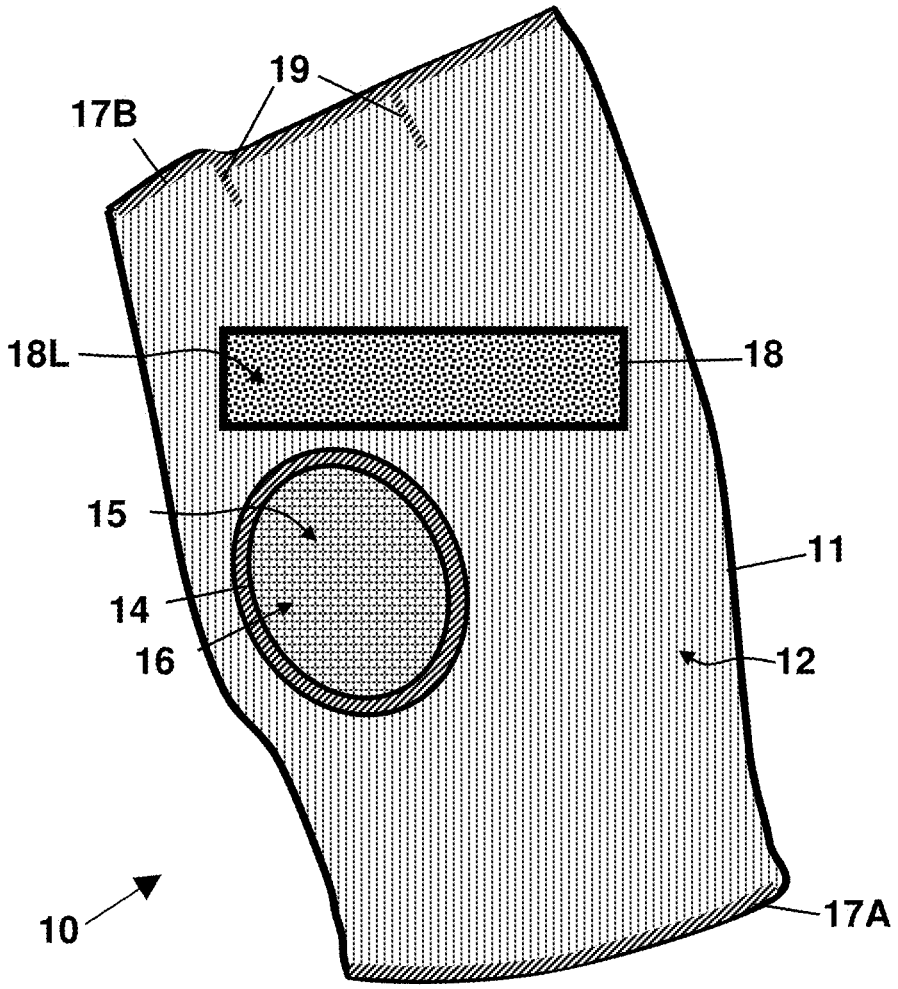
FIG. 2A is a plan view of the palm side of a left hand fingerless glove 10 composed of fabric with an outer surface and with a seam which defines a thumb hole through the fabric.

FIG. 2A is a plan view of the palm side of a left hand fingerless glove 10 composed of fabric 11 with an outer surface 12 and with a seam 14 which defines a thumb hole 15 through the fabric 11. The inner surface 16 of the fabric 12 is exposed through the thumb hole 15. A loop type fastener 18 is shown extending across the glove 10 above the thumb hole 15 at the location of the palm, below the base of the fingers. The loop type fastener 18 is bonded to the fabric 12 of the glove 10 by adhesive supplied with the loop type fastener 18 or alternatively it is permanently fastened in position by threaded stitching. A lower seam 17A is shown on the bottom of the glove 10 through which a hand is to be inserted. An upper seam 17B is shown at the top of the glove 10 through which fingers of a hand are to be inserted (as illustrated in FIG. 3B), with only two finger separating seams 19 shown depending down below the upper seam 17B.

Band and Spacer Embodiment

Figure 2B:
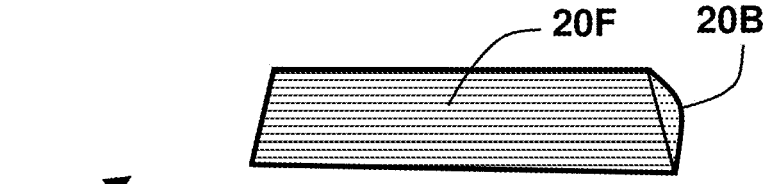
FIG. 2B is a perspective view of front of a wooden spacer with a flat front surface and a curved back surface. The wooden spacer has a low enough coefficient of friction to slide freely along the neck of a string instrument.

FIG. 2B is a perspective view of front of a wooden spacer 20 with a flat front surface 20F and a curved back surface 20B. The spacers have a low enough coefficient of friction to slide freely along the neck of a string instrument.

Figure 2C:
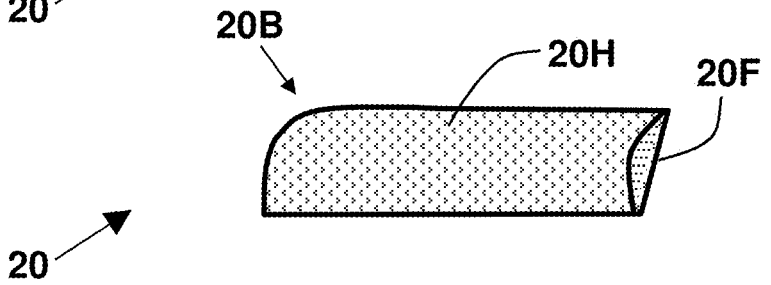
FIG. 2C is a perspective view of the back of the wooden spacer of FIG. 2B with the flat front surface 2 behind the curved back surface which has a layer of hook type fastener 2 covering the back surface.

FIG. 2C is a perspective view of the back of the wooden spacer 20 of FIG. 2B with the flat front surface 20F behind the curved back surface 20B which has a layer of hook type fastener 20H covering the back surface 20B.

Figure 3A:
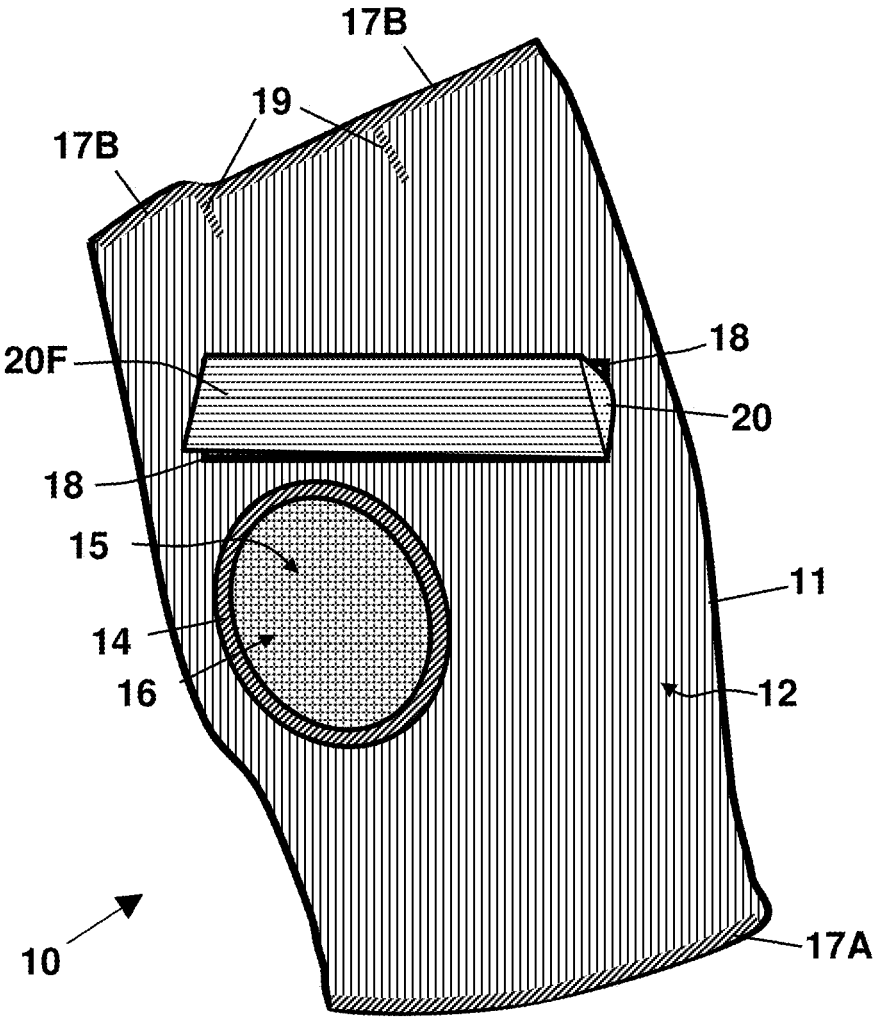
FIG. 3A shows the fingerless glove of FIG. 2A with the wooden spacer fastened to the palm side of glove by the hook type fastener of FIG. 2C on the back of the wooden spacer which is bonded to the loop type fastener of FIG. 2A on the palm of the glove.
Figure 3B:
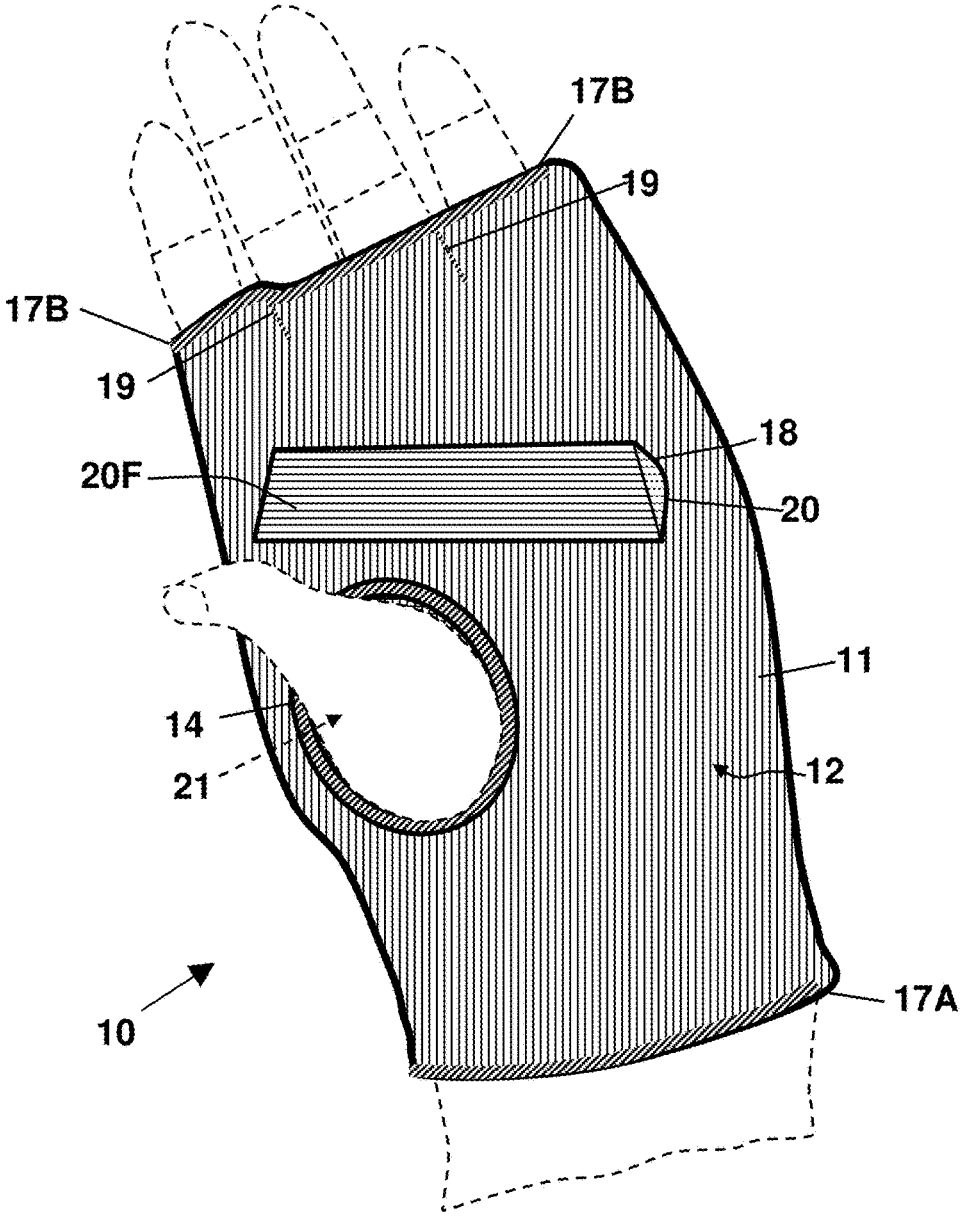
FIG. 3B shows the glove and the wooden spacer of FIG. 2A illustrating how the glove and the wooden spacer would appear with a thumb and fingers of a hand (shown in phantom) when the wooden spacer is ready for use by a player.

FIG. 3A shows the fingerless glove 10 of FIG. 2A with the wooden spacer 20 fastened to the palm side of glove 10 by the hook type fastener 20H of FIG. 2C. As will be well understood by those skilled in the art, the fastener 20H is located on the back of the wooden spacer 20 which is bonded to the loop type fastener 18 of FIG. 2A on the palm of the glove 10.

FIG. 3B shows the glove 10 and the wooden spacer 20 of FIG. 2A. It illustrates how the glove and the wooden spacer 20 would appear with a thumb and fingers of a hand (shown in phantom) when the wooden spacer 20 is ready for use by a player.

Figure 3C:
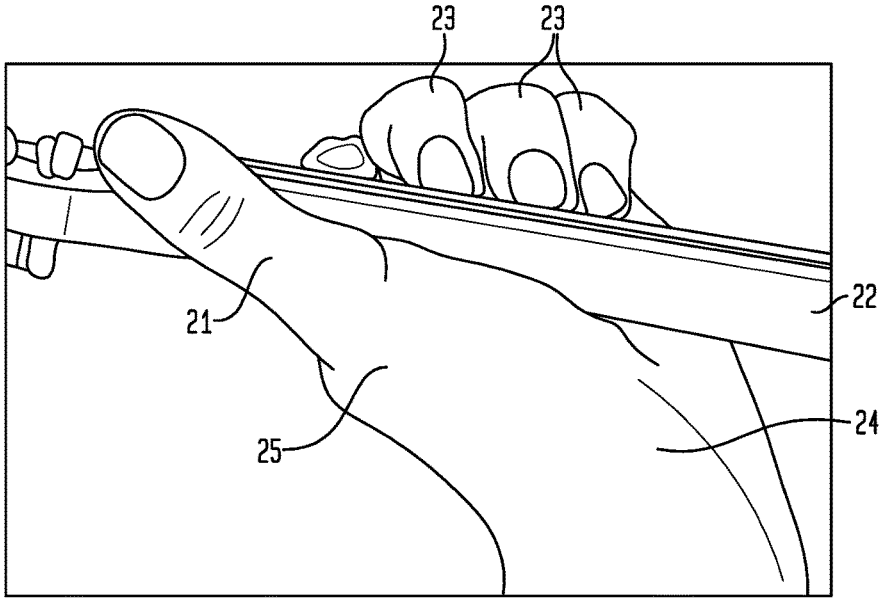
FIGS. 3C-3E are photographs of a hand and a neck of a string instrument illustrating in FIGS. 3C and 3E the problems of holding the neck whereas a solution in accordance with this invention is illustrated by FIG. 3D.
Figure 3D:
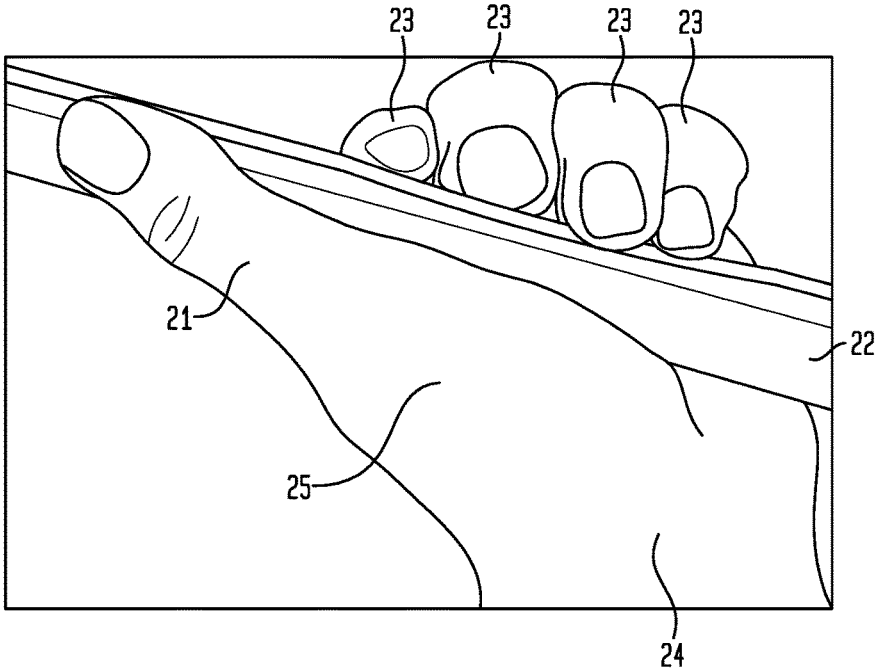

FIGS. 3C and 3D are photographs showing a hand 25 of a performer grasping the neck 22 of a guitar (not shown) without a spacer or shim with some of the fingers 23 positioned to make an A chord. Notice how the palm 26 of the hand 25 has to be pressed against the neck 22 so all the strings can be pressed down and notice how the wrist 24 is strained as it is bent at an angle to the left. The strain on the wrist 24 is caused by pushing with sufficient force to close the gap between the neck 22 and the palm 26 of the hand 25 as can be seen in these two photographs. That illustrates the problem of performing a chord without a spacer 20 between the palm 26 and the neck 22 of a string instrument by providing space between the palm 26 and the neck 22 as shown in FIG. 3E.

Figure 3E:
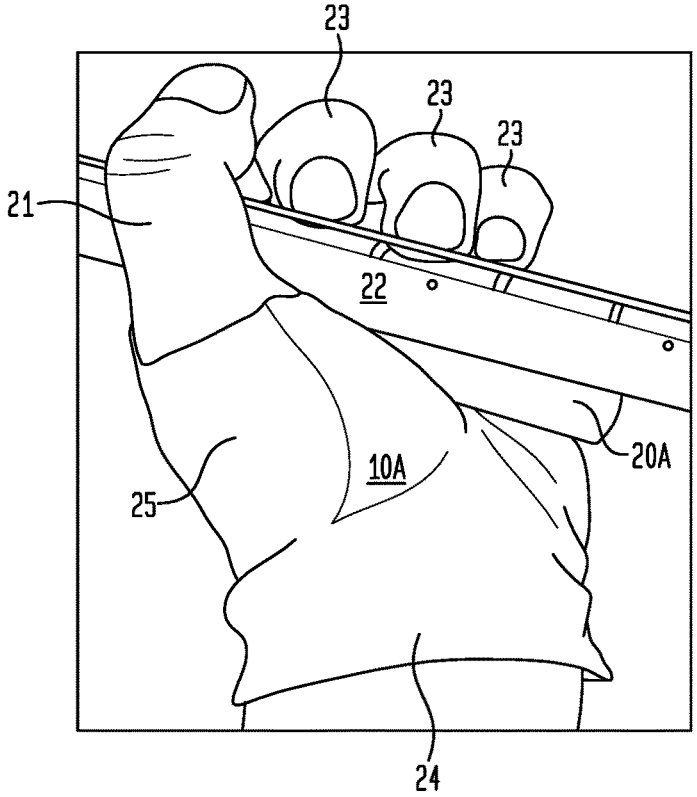

FIG. 3E is a photograph showing a hand 25 with the thumb 21 and the fingers 23 extending from a glove 10A secured to a wooden spacer 20A over the palm 26. The spacer 20A is in direct contact with the back of the neck 22 of a string instrument with the fingers 23 and the thumb 21 grasping the front of the neck 22. Using the spacer 20A provides support so all the strings can be pressed down while putting less of a bend in the wrist 24 thereby removing some of the strain therefrom. The method of this invention as illustrated in FIG. 3E includes the step of increasing the effective thickness of the neck of a stringed musical instrument by securing a spacer device between the palm of the player and the exterior of the neck; whereby there is increased comfort, playability and encouragement of correct hand grip and hand position on the neck of the instrument as well as decreased hand and finger and wrist fatigue. The method also includes the step of inserting the spacer device with a uniform thickness in the thenar compartment of the hand, between the thumb and index finger, extending through the webbing of the thenar space. Moreover the method includes the steps which are to provide a spacer which extends at least partially across radial longitudinal palm crease and/or which extends further across central compartment and/or which extends across the hypothenar compartment of the hand.

Figure 3F:
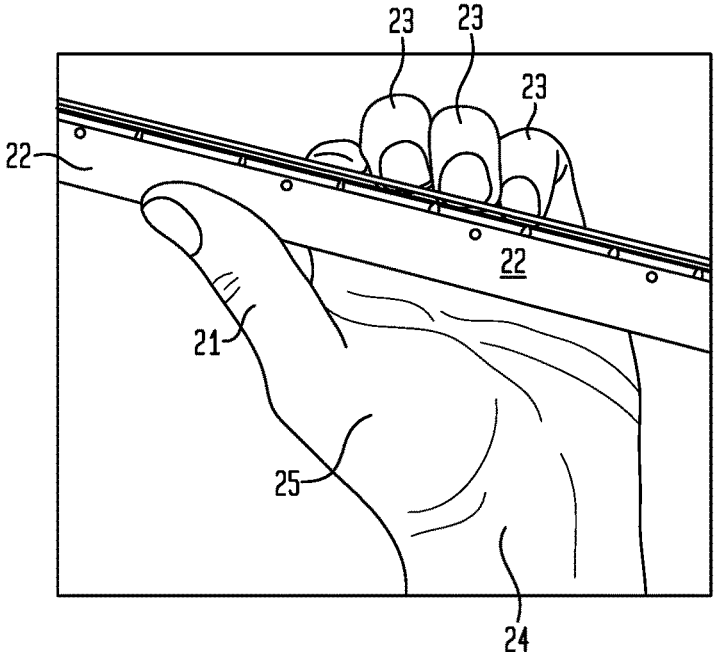
FIG. 3F is a photograph showing another common manner in which a performer holds the neck of a guitar which manner of holding the neck causes strain. Notice in this case instead of the problem of pressure on the wrist, all of the pressure is on the thumb which causes the performer a lot of pain in a short time. Using a spacer shifts the pressure to the palm in the center of the hand, where it is much better tolerated, as well as relieving the pressure on the thumb and straightening the wrist.

FIG. 3F is a photograph showing another common way performers hold the neck 22 of a guitar (without a spacer or shim) which causes strain. Notice in this case that instead of the problem of pressure on the wrist 24, all of the pressure is concentrated on the thumb 21 causing a lot of pain in a short time. Using a spacer 20 shifts the pressure to the palm 26 to the center of the hand 25 where its much better tolerated, while having the advantages of both relieving the pressure on the thumb 21 and straightening the angle of the wrist 24.

30F and inner surface 301 of a band 30 of two strips of fabric 30L/30P. The band 30 is open at its band ends 30E, and the band 30 is looped around with its band ends 30E juxtaposed at the back. That leaves a narrow gap 300 between the band ends 30E. In other words, the band 30 is folded around so that band ends 30E are almost joined at the narrow gap 300 at the back of band 30. The two different strips comprise a loop-fabric strip 30L and a plain fabric strip 30P. The loop-fabric strip 30L is on the exterior side of the band 30 and the plain fabric strip 30P inner (reverse) side 301 of the band 30 are sewn together by rows of stitching 32 on the top and on the bottom of the band 30. The loop-fabric strip 30L is adapted to bond to the strips of hook-fabric 67 and 69 shown in FIGS. 6B and 6C, as described in more detail below. The interior (reverse) side of the band 30 is a strip of plain fabric 30P.

Figure 4A:
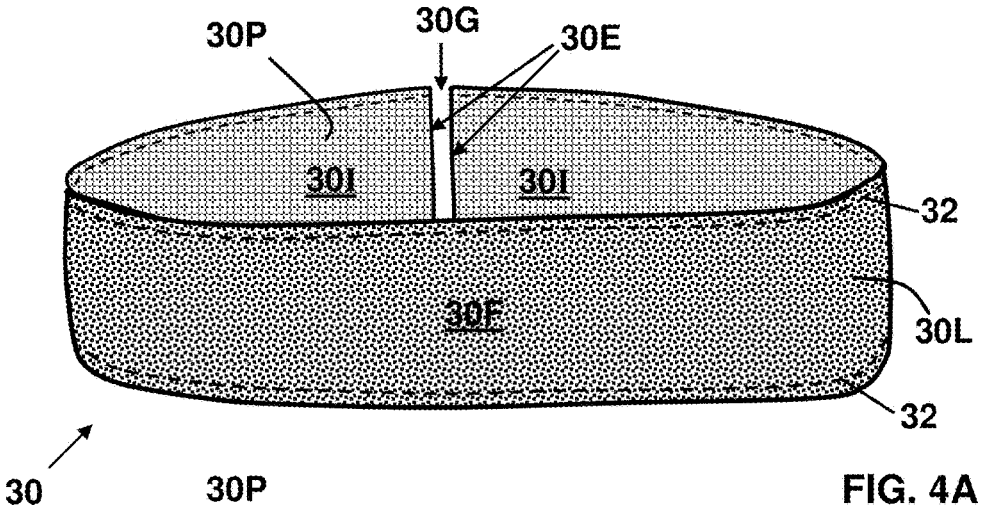
FIG. 4A shows a front perspective view of portions of the outer surface and the inner surface of a band of two strips of fabric.
Figure 4B:
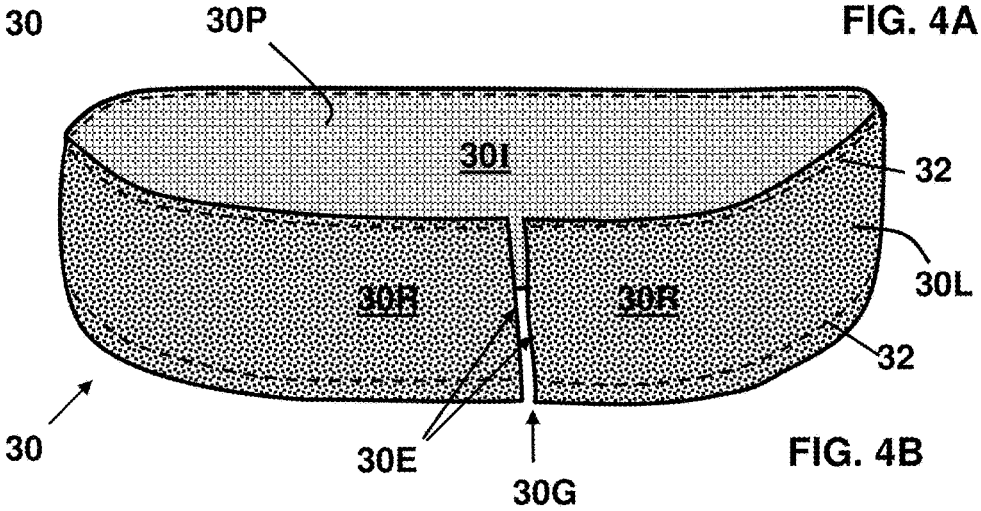
FIG. 4B shows an inverted, rear, perspective view of the band of FIG. 4A, with the gap shown between the ends of the band.

FIG. 4B shows an inverted, rear, perspective view of the band 30 of FIG. 4A, with the gap 300 shown between the ends 30E of the band 30.

Figure 5A:
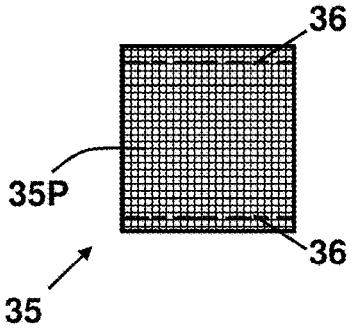
FIG. 5A shows the front side of a fastening patch composed of two pieces of fabric on opposite sides of the fastening patch sewn together by stitching.

FIG. 5A shows the front side of a fastening patch 35 composed of two pieces of fabric on opposite sides of the fastening patch 35 sewn together by stitching 36. The fastening patch 35 is employed to fasten the ends 30E of the band 30 together. The exterior side of the fastening patch 35 comprises plain-fabric strip 35P of material.

Figure 5B:
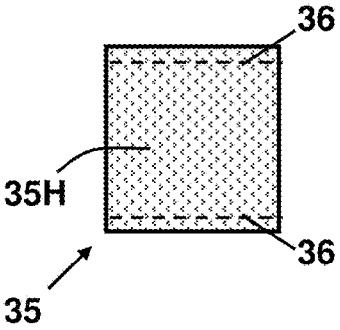
FIG. 5B shows the interior side of the fastening patch of FIG. 5A comprising a hook-fabric piece adapted to hook to the loop fabric of FIGS. 4A and 4B.

FIG. 5B shows the interior side of the fastening patch 35 of FIG. 5A comprising a hook-fabric piece 35H adapted to hook to the loop fabric 30L of FIGS. 4A and 4B. FIG. 5A also shows that the front side of the fastening patch 35 comprises plain fabric strip 35P secured to the hook fabric piece 35H of patch 35 FIG. 4D by stitching 36.

Figure 6A:
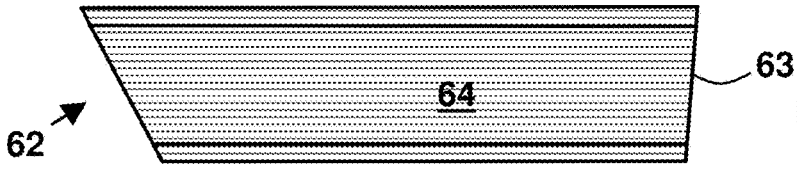
FIGS. 6A, 6B and 6C show front back and end views of a spacer composed of wood which is adapted to be attached to the front of band of FIG. 4A by strips of hook material bonded to the back of the spacer. The wooden spacer has a low enough coefficient of friction to slide freely along the neck of a string instrument.
Figure 6B:
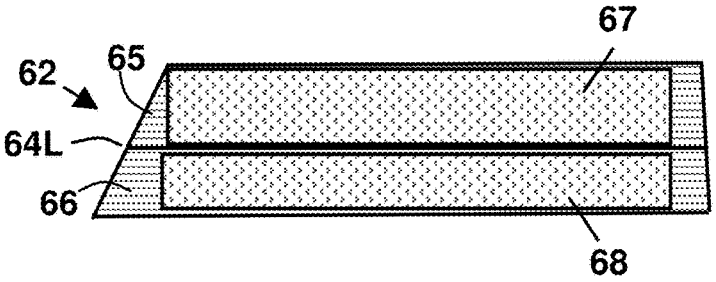
Figure 6C:
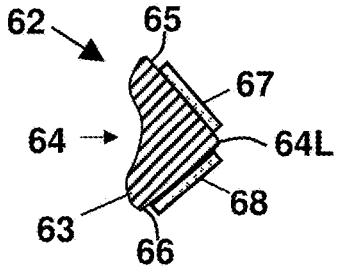

FIGS. 6A, 6B and 6C show front back and end views of a spacer 62 composed of wood 63 which is adapted to be attached to the front of band 30 of FIG. 4A of fabric strips by bonding strips of hook material 67/68 bonded to the two back surfaces 65/66 of the spacer 62.

FIG. 6A is a front view of the spacer 62 with a concave front surface 64 adapted to receive a curved neck of a string instrument.

FIG. 6B is a view of the back of the spacer 62, of FIG. 6A, with upper side 65 and lower side 66. The upper side 65 and a lower side 66 form a right angle indicated by line 64L which extends across the back of spacer 62. A first bonding strip 67 of hook material is bonded to the upper side 65 of the spacer 62. A second bonding strip 68 of hook material is bonded to the lower side 66 of the spacer 62. The first and second hook material bonding strips 67/68 are provided to bond the spacer 62 to the band 30, as shown in FIG. 7A temporarily.

However, alternative permanent bonding strips in place can be employed to bond the spacer 62 to the band 30 permanently, as will be well understood by those skilled in the art.

Figure 7A:
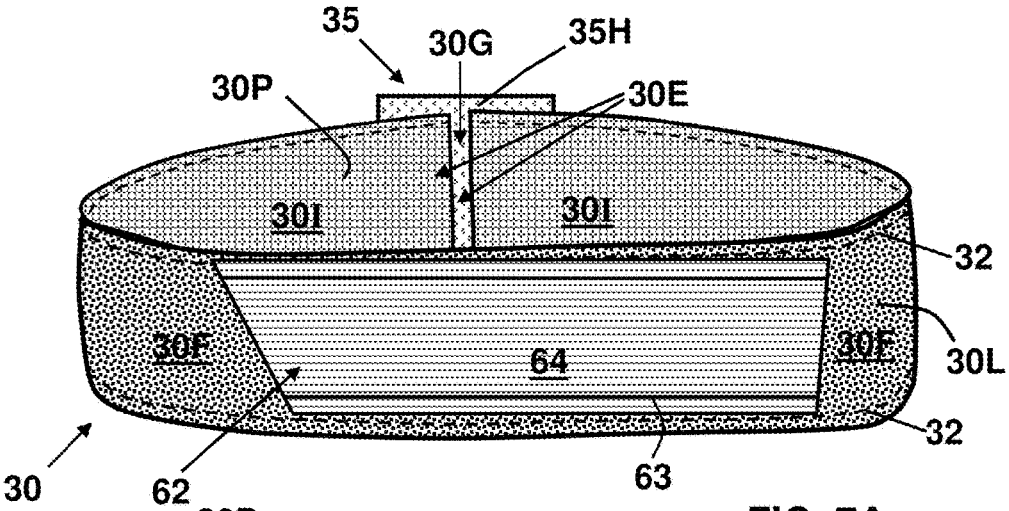
FIG. 7A shows a modified front perspective view of the band of FIG. 4A with the hook-fabric piece shown in FIG. 5B of the fastening patch bonded to the strip of looped fabric at the back of the band.

FIG. 7A shows a modified front perspective view of the band 30 of FIG. 4A. In FIG. 7A, the spacer 62 has been secured to the front of the outer surface 30F of the band 30 by the first and second bonding strips 67/68 secured to the upper and lower sides 65/66 of spacer 62. The hook-fabric piece 35H shown in FIG. 5B of the fastening patch 35 is bonded to the loop-fabric strip 30L fabric at the back of the band 30 bridging and securing the band ends 30E together so that the band 30 of FIG. 7A is ready to be secured to the hand of the player of a stringed instrument or the like with the spacer 62 in place or placed in juxtaposition with a curved neck of the stringed instrument.

Figure 7B:
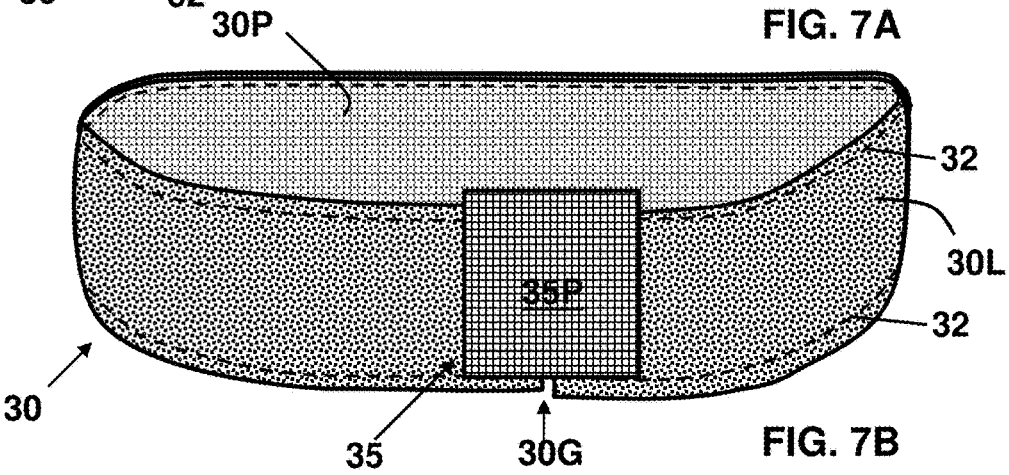
FIG. 7B shows an inverted, rear, perspective view of the band of FIG. 4A and FIG. 7A, with the gap at the back of the band bridged by the fastening patch of FIG. 5A and FIG. 5B.

FIG. 7B shows an inverted, rear, perspective view of the band 30 of FIG. 4A and FIG. 7A, with the gap 30G at the back of the band 30 bridged by the fastening patch 35 of FIGS. 5A and 5B. The plain fabric strip 35P on the exterior of the band 30 is shown in FIG. 7B while the hook-fabric strip 35H behind it is bonded to the loop-fabric strip 30L to hold the ends 30E together.

Figure 8:
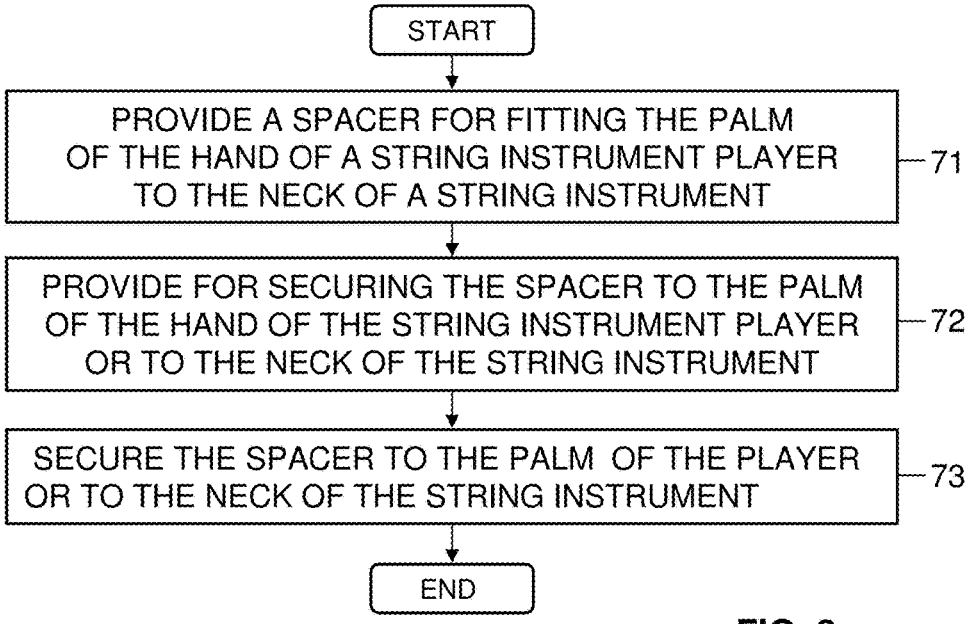
FIG. 8 is a flow chart of a first embodiment of the method of this invention.

FIG. 8 is a flow chart of a first embodiment of the method of this invention. In step 71 one provides a spacer for fitting the palm of the hand of a string instrument player to the neck of a string instrument. In step 72 one provides for securing the spacer to the palm of the hand of the string instrument player or to the neck of the string instrument. In step 73 one secures the spacer to the palm of the player or to the neck of the string instrument.

Figure 9:
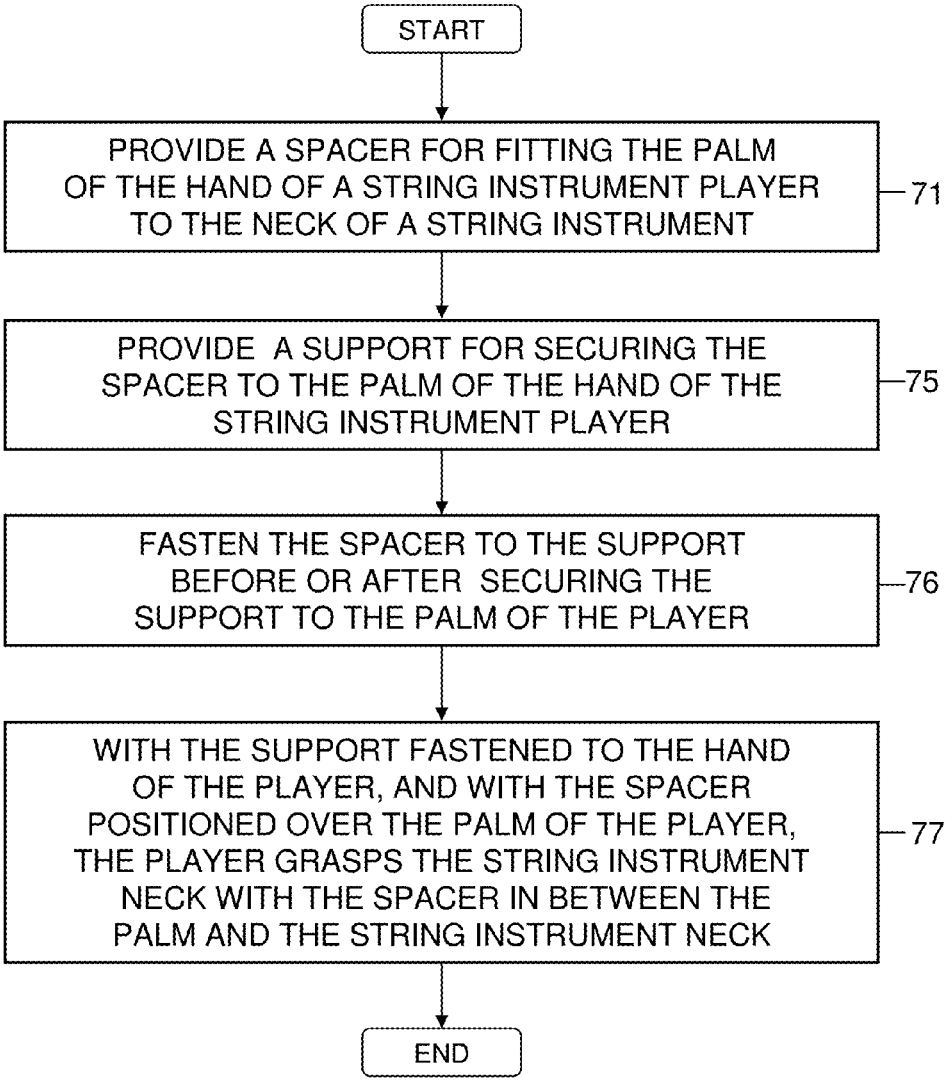
FIG. 9 is a flow chart of a second embodiment of the method of this invention which is a modification of the first embodiment of the method of this invention of FIG. 8.

FIG. 9 is a flow chart of a second embodiment of the method of this invention which is a modification of the method of this shown in FIG. 8. Step 71 is as described above. In the next step, which is step 75, one provides a support for securing the spacer to the palm of the hand of the string instrument player. In step 76, one fastens the spacer to the support before or after securing the support to the palm of the player. In step 77, with the support fastened to the hand of the player and with the spacer positioned over the palm of the player, the player grasps the string instrument neck with the spacer located between the palm and the string instrument neck. It is an important feature of the invention that the spacer has a low enough coefficient of friction to slide freely along the neck of the string instrument.

Figure 10:
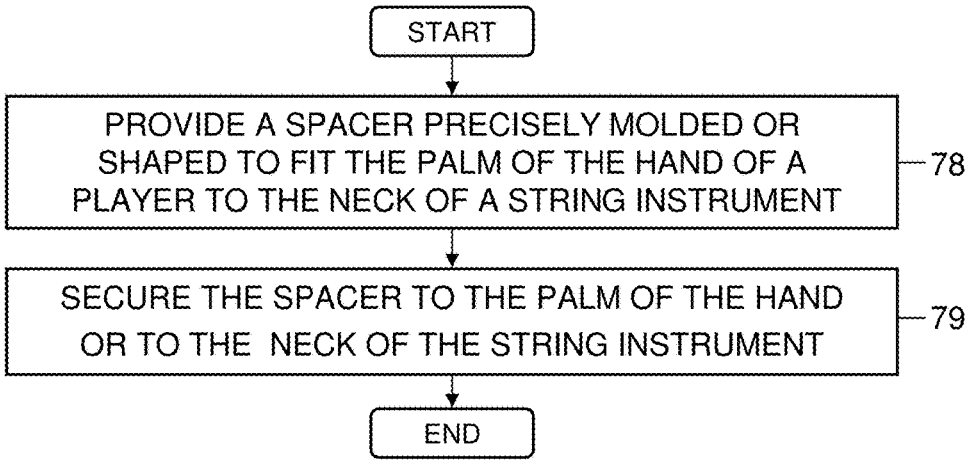
FIG. 10 is a flow chart of a third embodiment of the method of this invention.

FIG. 10 is a flow chart of a third embodiment of the method of this invention. Step 78 provides a spacer precisely molded or shaped to fit the palm of the hand and to fit the neck of a string instrument. In step 79 secure the spacer to the palm of the hand or to the neck of a string instrument. Techniques for forming molds or shaping a device to fill an open space are well known to those skilled in the art. It is known to create a plaster of Paris body part followed by use of CAD/CAM, CNC machines and 3D printing devices to form a device which fits the mold. Thus, those skilled in the art will understand how to form a spacer which fits between the palm of the hand of the player and the neck of the string instrument, as required by step 78. Again in this case, it is an important feature of the invention that the spacer has a low coefficient of friction adapted for sliding of the spacer freely along the neck of the string instrument.

Spacer Materials

Alternatives materials for the spacer other than wood are rigid plastics or materials which are more flexible than wood or rigid plastics selected from the group of stiff but flexible materials including felt, natural, synthetic or resin elastomers having a low coefficient of friction, elastomers including rubber, synthetic polyisoprene, polybutadiene, butadiene-styrene copolymers, butadiene-acrylonitrile copolymers, butadiene styrene acrylonitrile copolymers, polychloroprene and similar rubber products of 1,3-diene monomers having a markedly reduced coefficient of friction. Other suitable materials for inclusion in the group of materials suitable for a spacer include flexible plastic polymer materials like carbon fiber or carbon fiber composites, nylon, styrofoam, polytetrafluoroethelene (Teflon™), acrylic, silicone, fiberglass, PVC, polypropylene, polyethylene or PolyEtherEtherKetone (PEEK™)) polymer which have a low coefficient of friction and can be flexible.

Figure 11:
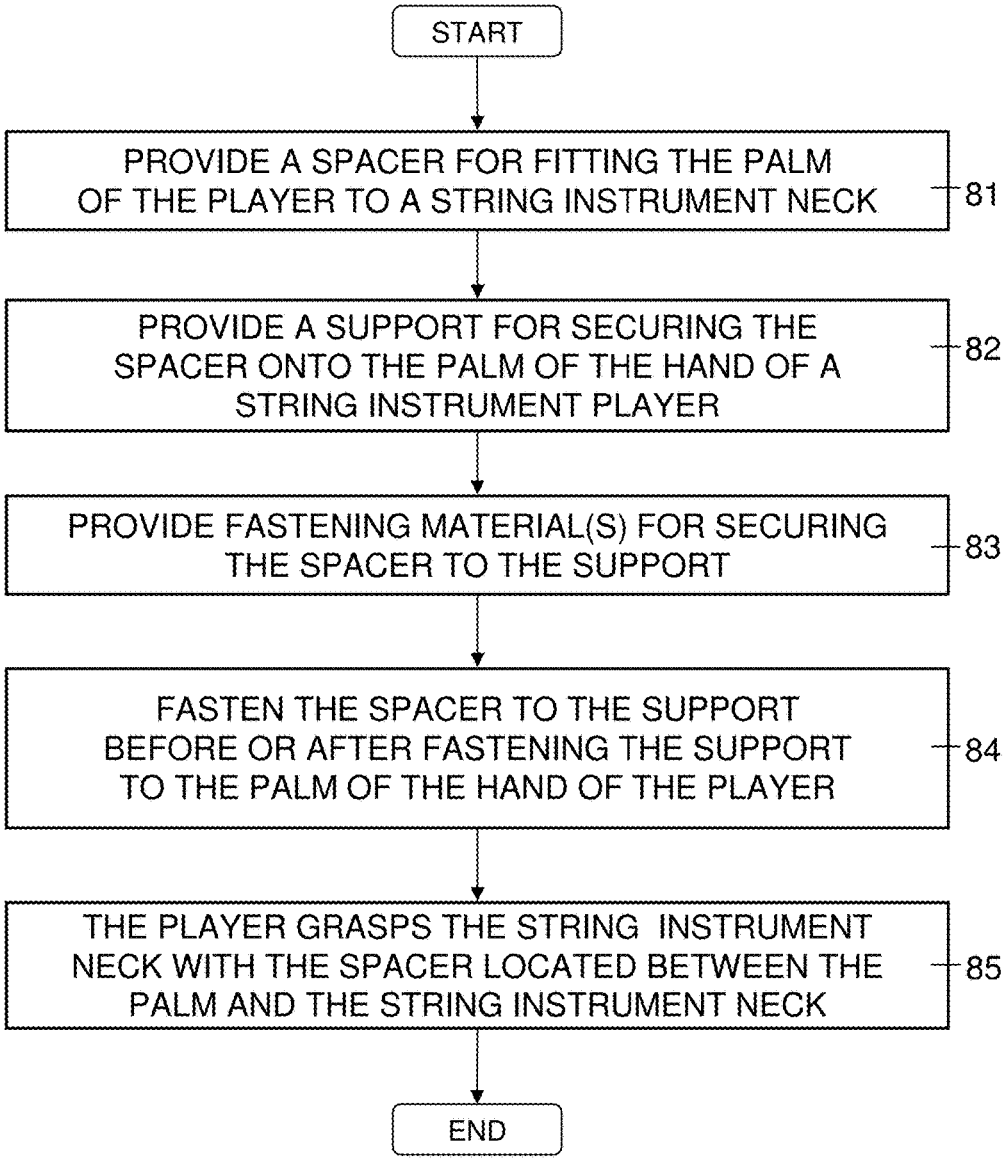
FIG. 11 is a flow chart of a fourth embodiment of the method of this invention.

FIG. 11 is a flow chart of a fourth embodiment of the method of this invention. In step 81, provide a spacer for fitting the palm of the player to the neck of a string instrument. In step 82 provide a support for securing the spacer onto the palm of the hand of a string instrument player. In step 83, provide fastening material(s) for securing the spacer to the support. In step 84 fasten the spacer to the support before or after fastening the support to the palm of the hand of the player. In step 85, the player grasps the string instrument neck with the spacer located between the palm and the string instrument neck. In this case, also it is an important feature of the invention that the spacer has a low enough coefficient of friction to slide freely along the neck of the string instrument.

Figure 12:
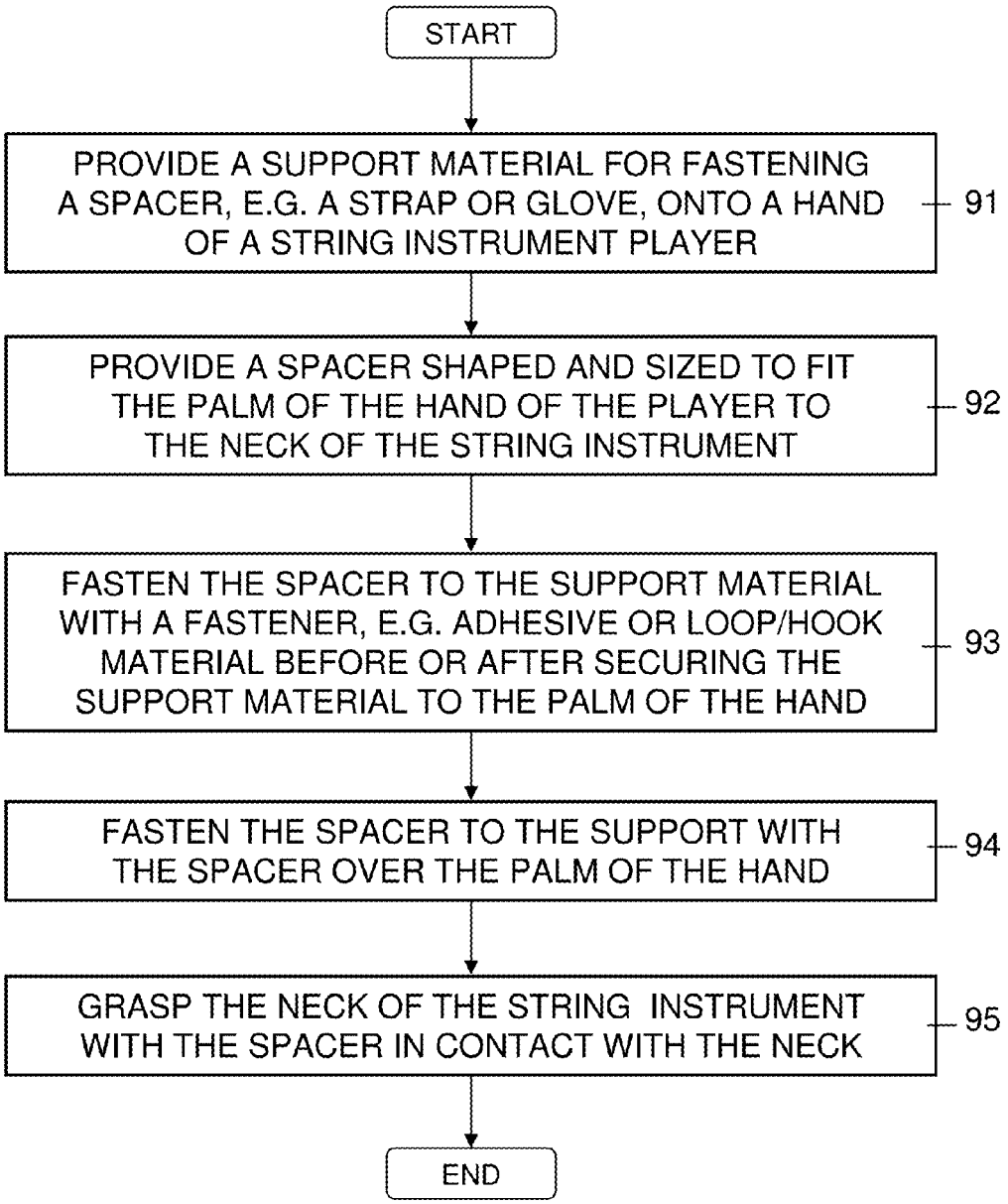
FIG. 12 is a flow chart of a fifth embodiment of the method of this invention.

FIG. 12 is a flow chart of a fifth embodiment of the method of this invention. In step 91, provide a support material for fastening a spacer, e.g. a strap or glove, onto a hand of a string instrument player. In step 92, provide a spacer shaped and sized to fit the palm of the hand of the player to the neck of the string instrument. In step 93, fasten the spacer to the support material with a fastener, e.g. adhesive or loop/hook material before or after securing the support material to the palm of the hand. In step 94, fasten the spacer to the support with the spacer over the palm of the hand. In step 95, the player grasps the neck of the string instrument with the spacer in contact with the neck. In this case too, it is an important feature of the invention that the spacer has a low enough coefficient of friction to slide freely along the neck of the string instrument.

The foregoing description discloses only exemplary embodiments of the invention. Modifications of the above disclosed apparatus and methods which fall within the scope of the invention will be readily apparent to those of ordinary skill in the art. While this invention is described in terms of the above specific exemplary embodiment(s), those skilled in the art will recognize that the invention can be practiced with modifications within the spirit and scope of the appended claims, i.e. changes can be made in form and detail, without departing from the spirit and scope of the invention. Accordingly, while the present invention is disclosed in connection with exemplary embodiments thereof, it should be understood that changes can be made to provide other embodiments which may fall within the spirit and scope of the invention and all such changes come within the purview of the present invention and the invention encompasses the subject matter defined by the following claims.

What is claimed is:

1. A method for increasing comfort of a player with the player having a hand and a palm and the with the player holding a neck of a stringed musical instrument by providing a spacer device for fitting the palm of the hand of the stringed musical instrument player to the neck of a stringed musical instrument by the step comprising:

increasing an effective thickness of the neck of the stringed musical instrument by securing the spacer device between the palm of the hand of the player and an exterior of the neck of the stringed musical instrument;

with the hand including a thumb and an index finger, with the hand including a radial longitudinal palm crease, a central compartment, a webbing of a thenar space, and a thenar compartment of the hand;

whereby there is increased comfort, playability and encouragement of correct hand grip and hand position on the neck of the stringed musical instrument as well as decreased hand and finger and wrist fatigue of the player.

2. The method of claim 1 comprising eliminating a gap between the palm of the hand and the neck of the stringed musical instrument with the spacer device secured therebetween.

3. The method of claim 1 wherein the spacer device is tapered.

4. The method of claim 1 comprising:

inserting the spacer device with a uniform thickness in the thenar compartment of the hand, between the thumb and index finger, extending through the webbing of the thenar space; and by the steps as follows:

extending at least partially across the radial longitudinal palm crease and/or further extending across the central compartment and/or extending across the thenar compartment of the hand.

5. The method of claim 4 wherein:

the spacer device comprises material precisely molded or shaped to fit the palm of the hand to the neck of the stringed musical instrument; and pressing the palm of the hand against the spacer device which is thereby pressed against the neck of the stringed musical instrument.

6. The method of claim 1 including:

providing for securing the spacer device to the palm of the hand of the player of the stringed musical instrument, and securing the spacer device to a support before or after securing the support to the palm of the player.

7. The method of claim 6 wherein:

the spacer device comprises material precisely molded or shaped to fit the palm of the hand to the neck of the stringed musical instrument; and pressing the palm of the hand against the spacer device which is thereby pressed against the neck of the stringed musical instrument.

8. The method of claim 1 wherein:

the spacer device comprises material precisely molded or shaped to fit the palm of the hand to the neck of the stringed musical instrument; and the spacer device is attached directly to the palm of the hand or held in place by pressing the palm of the hand against the spacer device which is thereby pressed against the neck of the stringed musical instrument.

9. The method of claim 4 comprising the spacer device attached to the palm of the hand using an attachment means.

10. The method of claim 1 comprising:

adding the spacer device in the form of a piece of material to the neck of the stringed musical instrument, said piece of material being selected from the group consisting of plastic and wood;

fastening the piece of material to the neck of the stringed musical instrument using fastening means selected from the group consisting of glue and adhesive, hook and loop fasteners;

whereby the thickness of the neck of the instrument is increased.

11. The method comprising: providing a spacer for fitting the palm of the hand of the stringed musical instrument player to the neck of a stringed musical instrument, and providing for securing the spacer to the neck or to the palm of the hand of the stringed musical instrument player.

12. The method of claim 11 including:

providing a support for securing the spacer to the palm of the hand of the player of the stringed musical instrument;

fastening the spacer to the support before or after securing the support to the palm of the player; and with the support fastened to the hand of the player, the player then grasping the neck of the stringed musical instrument with the spacer located between the palm and the neck of the stringed musical instrument.

13. The method of claim 1 wherein the spacer device has a low coefficient of friction adapted for sliding thereof freely along the neck of the stringed musical instrument.

14. The method of claim 2 wherein the spacer device has a low coefficient of friction adapted for sliding of the spacer device freely along the neck of the stringed musical instrument.

15. The method of claim 3 wherein the spacer device has a low coefficient of friction;

whereby the spacer device slides freely along the neck of the stringed musical instrument.

16. The method of claim 4 wherein the spacer device has a low coefficient of friction;

whereby the spacer device slides freely along the neck of the stringed musical instrument.

17. The method of claim 5 wherein the spacer device has a low coefficient of friction for sliding freely along the neck of the stringed musical instrument.

18. The method of claim 6 wherein the spacer device has a low coefficient of friction for sliding freely along the neck of the stringed musical instrument.

19. The method of claim 11 wherein the spacer device has a low coefficient of friction for sliding freely along the neck of the stringed musical instrument.

20. The method of claim 12 wherein the spacer device has a low coefficient of friction for sliding freely along the neck of the stringed musical instrument.

* * * * *